US010948222B2

(12) United States Patent
Zerovnik et al.

(10) Patent No.: US 10,948,222 B2
(45) Date of Patent: Mar. 16, 2021

(54) HYBRID THERMAL APPARATUS

(71) Applicant: UNIVERZA V LJUBLJANI, Ljubljana (SI)

(72) Inventors: Andrej Zerovnik, Horjul (SI); Jaka Tusek, Ljubljana (SI)

(73) Assignee: UNIVERZA V LJUBLJANI, Ljubljana (SI)

( * ) Notice: Subject to any disclaimer, the term of this patent is extended or adjusted under 35 U.S.C. 154(b) by 58 days.

(21) Appl. No.: 16/346,235

(22) PCT Filed: Nov. 2, 2017

(86) PCT No.: PCT/IB2017/056804
§ 371 (c)(1),
(2) Date: Apr. 30, 2019

(87) PCT Pub. No.: WO2018/091995
PCT Pub. Date: May 24, 2018

(65) Prior Publication Data

US 2019/0264958 A1 Aug. 29, 2019

(30) Foreign Application Priority Data

Nov. 16, 2016 (SI) ..... P-201600283

(51) Int. Cl.
*F25B 23/00* (2006.01)
*F25B 25/00* (2006.01)
*F25B 21/00* (2006.01)

(52) U.S. Cl.
CPC ..... *F25B 23/00* (2013.01); *F25B 25/005* (2013.01); *F25B 21/00* (2013.01); *F25B 2321/001* (2013.01); *F25B 2339/047* (2013.01)

(58) Field of Classification Search
CPC .. F25B 25/005; F25B 2339/047; F25B 23/00; F25B 21/00; F25B 2321/00;
(Continued)

(56) References Cited

U.S. PATENT DOCUMENTS 5,339,653 A * 8/1994 DeGregoria ..... A62B 9/003 165/10
6,332,323 B1 * 12/2001 Reid ..... F25B 29/003 62/6

(Continued)

FOREIGN PATENT DOCUMENTS

CN 101982502 A 3/2011
CN 105823255 A 8/2016

(Continued)

OTHER PUBLICATIONS

International Search Report and Written Opinion for corresponding International Application No. PCT/IB2017/056804 dated Feb. 7, 2018.

(Continued)

*Primary Examiner* — Frantz F Jules
*Assistant Examiner* — Martha Tadesse
(74) *Attorney, Agent, or Firm* — Renner, Otto, Boisselle & Sklar, LLP

(57) ABSTRACT

The present invention refers to a hybrid thermal apparatus comprising at least one heat exchanger and at least one heat source and/or heat sink. The thermal apparatus according to the invention is formed as a combination of a first thermal apparatus (1, 15) based on a vapour-compression principle and comprising a first medium for heat transfer, and of a second thermal apparatus (2, 16) based on an elastocaloric principle and comprising a second medium for heat transfer. Said thermal apparatuses (1, 15; 2, 16) have at least one deformable heat exchanger (3, 21) of elastocaloric material in common.

7 Claims, 2 Drawing Sheets

Figure 1:
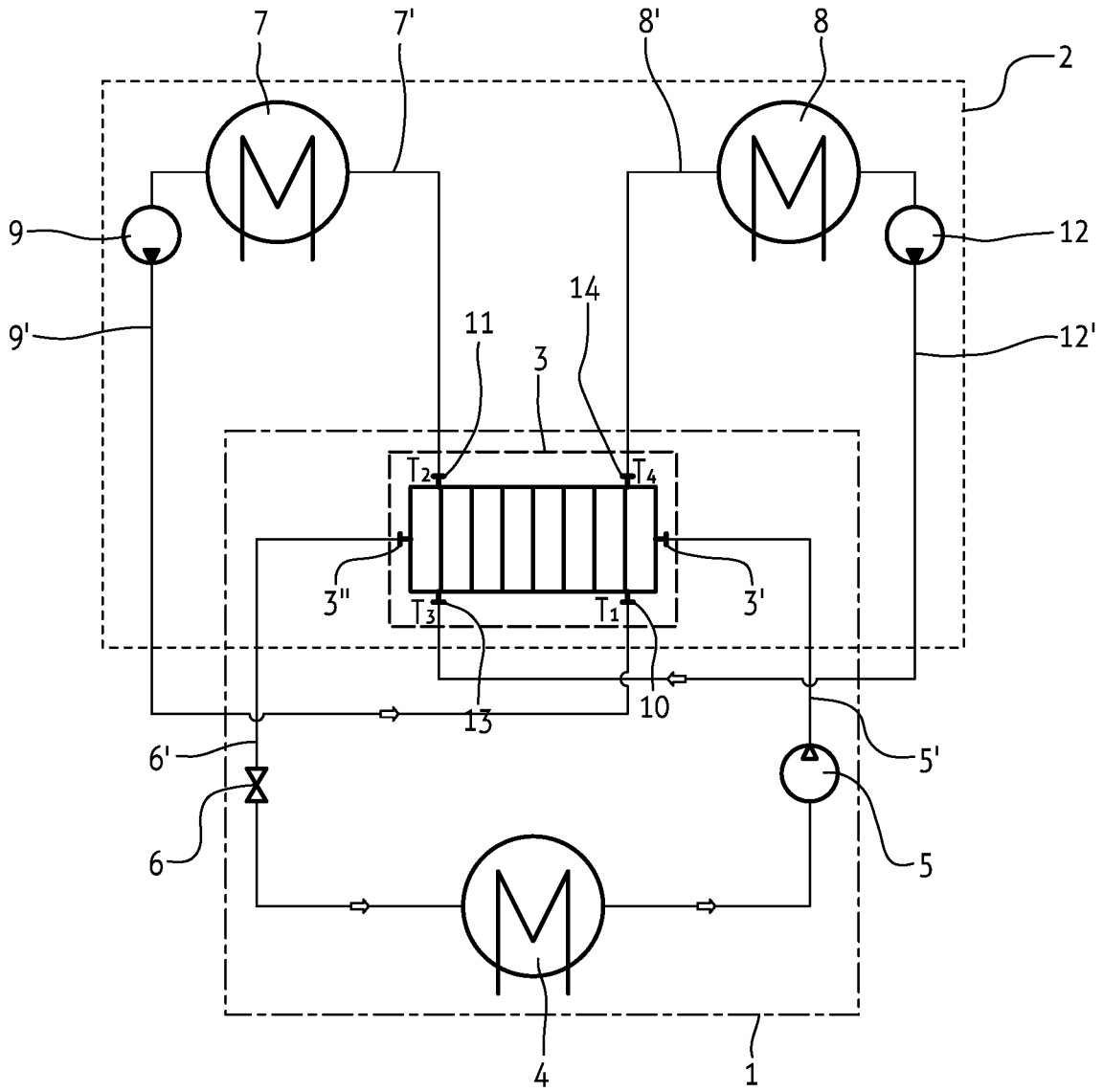

(58) Field of Classification Search
CPC ..... F25B 2321/001; F03G 7/06; C09K 5/14; G05D 23/02
See application file for complete search history.

(56) References Cited

U.S. PATENT DOCUMENTS

| | | | | |
|---|---|---|---|---|
| 6,367,281 | B1 * | 4/2002 | Hugenroth | F24V 99/00 62/467 |
| 9,121,647 | B2 * | 9/2015 | Cui | C22C 14/00 |
| 9,612,040 | B2 | 4/2017 | Casset | |
| 10,119,059 | B2 * | 11/2018 | Cui | F25B 23/00 |
| 2005/0051295 | A1 | 3/2005 | Yamanaka et al. | |
| 2012/0273158 | A1 * | 11/2012 | Cui | F25B 23/00 165/10 |
| 2015/0362224 | A1 * | 12/2015 | Benedict | F25B 21/00 62/3.1 |
| 2015/0369524 | A1 * | 12/2015 | Ikegami | F24F 3/1411 165/61 |
| 2016/0084544 | A1 * | 3/2016 | Radermacher | C09K 5/10 165/10 |
| 2018/0283742 | A1 * | 10/2018 | Radermacher | F25B 23/00 |
| 2019/0178536 | A1 * | 6/2019 | Schroeder | F25B 23/00 |
| 2019/0270221 | A1 * | 9/2019 | Driscoll | C04B 38/0605 |

FOREIGN PATENT DOCUMENTS

| | | | |
|---|---|---|---|
| JP | 2005172258 | A | 6/2005 |
| WO | 2013/079596 | A | 6/2013 |

OTHER PUBLICATIONS

Search report issued by Chinese Patent Office for corresponding Chinese Patent Application No. 2017800685532 dated Sep. 1, 2020.

* cited by examiner

HYBRID THERMAL APPARATUS

This application is a national phase of International Application No. PCT/IB2017/056804 filed Nov. 2, 2017 and published in the English language, which claims priority to Application No. SI P-201600283 filed Nov. 16, 2016, which are incorporated herein by reference.

The present invention refers to a hybrid thermal apparatus comprising at least one heat exchanger and at least one heat source and/or heat sink.

Hybrid thermal apparatuses of the aforementioned kind are generally known. Also, thermal apparatuses are known which are based on the vapour-compression technology. Said technology shows a relatively low energy efficiency, wherein more or less environmentally harmful means are exploited in order for said thermal apparatuses to operate. Recently were developed various alternative thermal apparatuses and technologies that are environment-friendly such as thermoelectric, thermoacoustic, sorption, magnetic, electrocaloric, elastocaloric and, respectively, thermoelastic technologies and similar, however, due to low heat capacity and/or efficiency and/or costly production none of said technologies did prove to be serious alternative to the compressor technology.

It is the object of the present invention to create a hybrid thermal apparatus which remedies drawbacks of the known solutions.

The object as set forth is solved, according to the present invention by a hybrid thermal apparatus, being either a cooling and/or heating thermal apparatus, which is formed as a combination of a first thermal apparatus based on a vapour-compression principle, and a second thermal apparatus based on an elastocaloric principle, wherein said thermal apparatuses have at least one deformable heat exchanger made of elastocaloric material in common. Said combination enables the increase of the heat capacity of the hybrid thermal apparatus and, as a result, increase of the efficiency. In case of a cooling apparatus and, respectively, a heat pump the hybrid thermal apparatus according to the invention, having the same capacity, operates with less cooling agent as the conventional vapour-compression apparatus does.

The essence of the present invention lies in exploiting of pressure difference of cooling agent which, with the conventional vapour-compression apparatus, occurs during compression stage and expansion stage of cooling agent, in order to obtain the elastocaloric effect. To this extent a hybrid thermal apparatus is provided for, according to the present invention, comprising direct and/or indirect transfer of pressure from cooling agent to the elastocaloric material. According to the second embodiment, a hybrid thermal apparatus is provided comprising a direct transfer of pressure from cooling agent to the elastocaloric material, wherein a deformable condenser is provided as an intermediary device.

Figure 2:
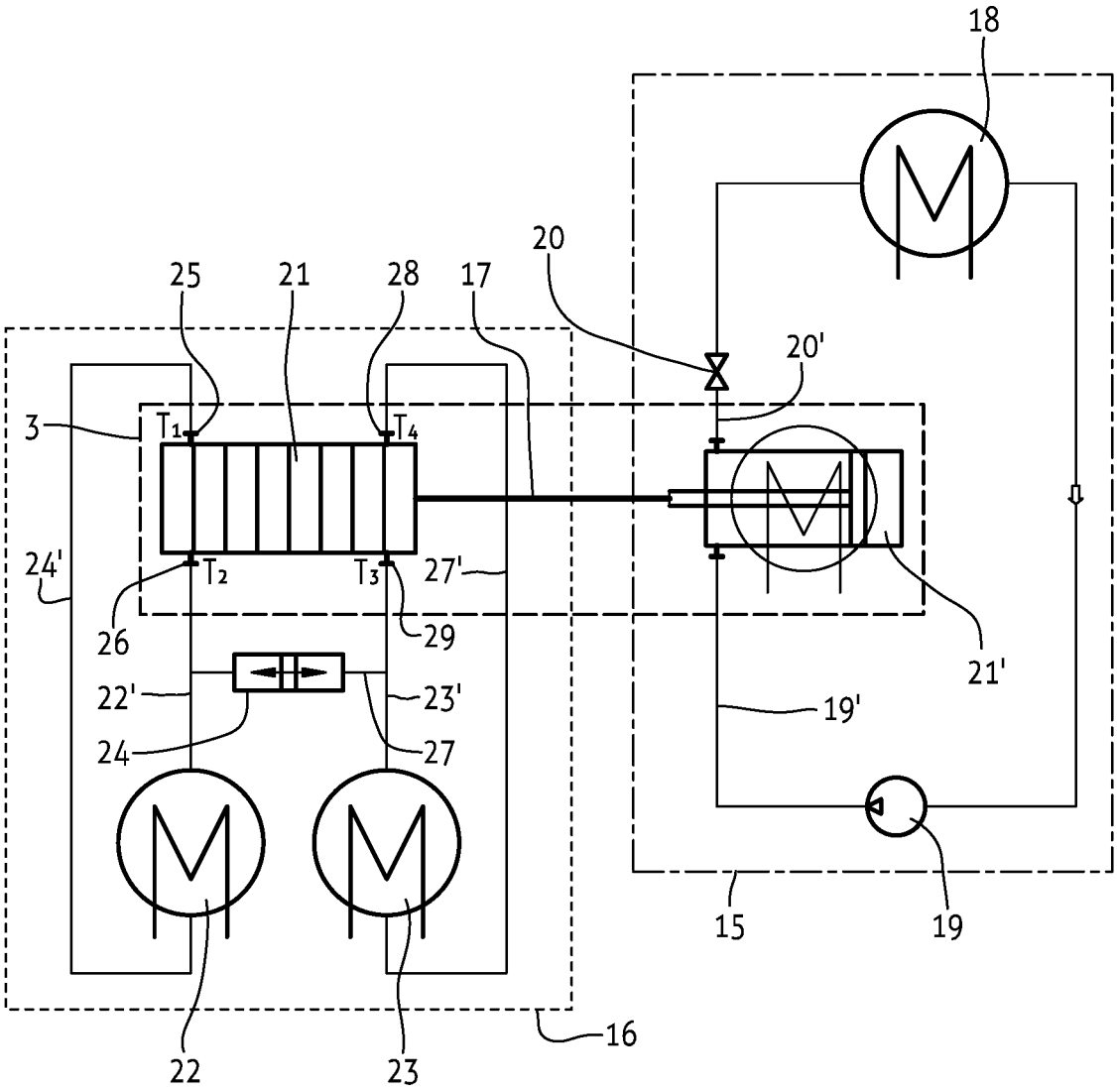

The invention is further described in detail by way of non-limiting embodiments, and with a reference to the accompanying drawings, where FIG. 1 shows a schematic view of a hybrid thermal apparatus according to the invention, FIG. 2 shows another embodiment of a hybrid thermal apparatus of FIG. 1.

The present invention is further described on a basis of a hybrid thermal apparatus selected as a cooling apparatus and, respectively, a heat pump. Such a thermal apparatus is formed as a combination of a first thermal apparatus 1 comprising a first medium for heat transfer, particularly cooling agent, and of a second thermal apparatus 2 comprising a second medium for heat transfer, water in the present embodiment, wherein a third thermal apparatus 3 is common to the thermal apparatuses 1, 2, particularly a heat exchanger. In the present embodiment, the first thermal apparatus 1 is based on a vapour-compression principle, and the second thermal apparatus 2 is based on elastocaloric principle, whereas the third thermal apparatus 3 is formed as a deformable heat exchanger made of elastocaloric material.

In the present embodiment, said third thermal apparatus 3 and, respectively, said deformable heat exchanger is selected as an elastocaloric recuperator. Said first thermal apparatus 1 comprises a first cold heat exchanger and, respectively, an evaporator 4 to which is connected at the downstream side a compression means 5 and to which is connected at the upstream upstream side an expansion valve 6. The compression means 5 is connected via a cooling agent supply line 5' with cooling agent inlet 3' into the recuperator 3, whereas the expansion valve 6 is connected via a discharge line 6' with cooling agent outlet 3" from the recuperator 3.

Said second thermal apparatus 2 comprises a hot heat exchanger 7 and a second cold heat exchanger 8. The hot heat exchanger 7 is connected at the downstream side with a pumping means 9 which is further connected via a supply line 9' with hot water inlet 10 on the recuperator 3. Moreover, the hot heat exchanger 7 is connected at the upstream side via a line 7' to hot water outlet 11 on the recuperator 3. Said cold heat exchanger 8 is connected downstream with a pumping means 12 which, in turn, is connected via a supply line 12' with cold water inlet 13 on the recuperator 3. Further, the cold heat exchanger 8 is connected at the upstream side via a line 8' with cold water outlet 14 on the recuperator 3. With the present first embodiment said connections 10, 11; 13, 14 on the recuperator 3 for hot water and, respectively, for cold water are arranged in a crosswise manner, which means that the hot water inlet 10 and the cold water outlet 14 are located at the first end of the recuperator 3, whereas the hot water outlet 11 and the cold water inlet 13 are located at the opposite end of the recuperator 3. It is, however; obviously that blocking means such as valves, for example, are provided at the respective places, the form and the location of said blocking means being known per se and not shown in detail.

A cyclic process of cooling/heating of the present embodiment of the hybrid thermal apparatus comprises four stages as follows. The first stage comprises pressing the cooling agent into the elastocaloric recuperator 3. Said expansion valve 6 is closed and the compression means 5 forces cooling agent into the recuperator 3. Circulating of water via the hot heat exchanger 7 and the cold heat exchanger 8 is prevented during the entire first stage of the process, or at least during a part of the first stage of the process. The cooling agent pressure increases during pressing of the cooling agent into the recuperator 3 causing the cooling agent to warm up. Said pressure increase of the cooling agent represents a load which is directly or indirectly transferred to the recuperator 3, whereby the latter is loaded and, respectively, deformed. Deformation of the recuperator 3 causes warming up of the elastocaloric material which constitutes the recuperator 3. Thus, the final outcome of the first stage is deformed elastocaloric material of the recuperator 3 and compressed cooling agent, while both being in hot state.

The second stage of said cyclic process of the hybrid thermal apparatus comprises heat removal from the recuperator 3. Supply of the compressed cooling agent is prevented during the entire second stage of the process, or at least during a part of the second stage of the process. Said pumping means 9 forces water with a first temperature $T_1$ from the hot heat exchanger 7 through the hot water inlet 10 and via the recuperator 3, wherein water with a second temperature $T_2$ is returning through the hot water outlet 11 into the hot heat exchanger 7. The flow through the cold heat exchanger 8 is prevented. During water flow through the recuperator 3 the heat passes from the recuperator 3 to said water, which results in cooling of the recuperator 3. Thus, the heat is removed from the elastocaloric material of the recuperator 3 and from the compressed cooling agent which, in turn, condensates and releases the heat. The water with a second temperature $T_2$ flows via the outlet 11 from the recuperator 3 to the hot heat exchanger 7 where heat is transferred either to the surrounding or, optionally, to another medium for heat transfer. Therefore, a first i.e. hot product is obtained in the hot heat exchanger 7. The final outcome of the second stage is deformed elastocaloric material of the recuperator 3 and compressed cooling agent.

The third stage of said cyclic process of the hybrid thermal apparatus comprises expansion of the cooling agent from the recuperator 3 to the evaporator 4. The inflow of the compressed cooling agent into the recuperator 3 is prevented, whereas the expansion valve 6 is open, wherein the flow of the water is prevented during the entire third stage of the process or at least during a part of the third stage of the process. The cooling agent expands through the expansion valve 6 from the recuperator 3 into the evaporator 4 resulting in the cooling agent to cool down during the expansion. The result of said expansion is a first cold product in the evaporator 4. Simultaneously, the result of the expansion is also emptying the recuperator 3 and deformation decreasing of elastocaloric material of the recuperator 3, which in turn cools down. The final outcome of said third stage is expanded cooling agent and the first cold product, and non-deformed and cold recuperator 3.

The fourth stage of said cyclic process of the hybrid thermal apparatus comprises cooling of water in the cooled recuperator 3. The flow through the compression means 5 is prevented during the entire fourth stage of the process or at least during a part of the fourth stage of the process. Said pumping means 12 transports water with a third temperature $T_3$ from the cold heat exchanger 8 through the cold water inlet 13 via recuperator 3, whereby the water with a fourth temperature $T_4$ returns through the cold water outlet 14 to the cold heat exchanger 8. The water having the third temperature $T_3$ flows from the cold heat exchanger 8 through the inlet 13 into the recuperator 3 where the water is cooled by said recuperator. More precisely, the water is cooled by the unloaded elastocaloric material of the recuperator 3 and by expanded cooling agent which in turn evaporates and receives heat of the inflowing water. As a result, the recuperator 3 gets slightly warm. In the described manner cooled water with a temperature $T_4$ flows through the outlet 14 into the cold heat exchanger 8, whereby the result of the fourth stage is a second cold product in the cold exchanger 8. The final outcome of said fourth stage is cold water in the cold heat exchanger 8, that is the second cold product and the non-deformed recuperator 3.

With the present embodiment, said second temperature $T_2$ of the water is higher than said first temperature $T_1$ of the water ($T_2>T_1$), and said third temperature $T_3$ of the water is higher than said fourth temperature $T_4$ of the water ($T_3>T_a$). In addition, it applies that the first and the second temperature $T_1$, $T_2$ are substantially higher that the third and the fourth temperature $T_3$, $T_4$ ($T_2>T_1>>T_3>T_4$).

On conclusion of said fourth stage said cyclic process of the thermal apparatus according to the invention returns to the first stage, thus, enabling the cyclic process to be carried out continuously.

FIG. 2 shows additional embodiment of the hybrid thermal apparatus according to the invention formed as a combination of a first thermal apparatus 15 based on the vapour-compression principle and comprising a first heat transfer medium, in particular a cooling agent, and a second thermal apparatus 16 based on the elastocaloric principle and comprising a second heat transfer medium that is water in the present embodiment. The third thermal apparatus 3, in particular a deformable heat exchanger, is common to said thermal apparatuses 15, 16, which in the present embodiment comprises an elastocaloric regenerator 21 associated by means of a deformation and, respectively, a load transmitter 17 with an intermediary device 21' in order to transfer pressure form the cooling agent to the elastocaloric material.

Said first thermal apparatus 15 comprises a cold heat exchanger and, respectively, an evaporator 18 to which is connected at the downstream side a compression means 19 and to which is connected at the upstream side an expansion valve 20. The compression means 19 is connected via a cooling agent supply line 19' with an inlet of the cooling agent into said intermediary device 21' for transfer pressure of the cooling agent, which operates for example as a deformable condenser and, respectively, a hot heat exchanger, whereas the expansion valve 20 is connected via a discharge line 20' with an outlet of the cooling agent from said intermediary device 21'.

Said second thermal apparatus 16 comprises a hot heat exchanger 22 and a second cold heat exchanger 23. The hot heat exchanger 22 is connected at the upstream side via a discharge line 24' with hot water outlet 25 on the elastocaloric regenerator 21. Further, the hot heat exchanger 22 is connected at the downstream side via a line 22' to hot water inlet 26 on the regenerator 21. Said cold heat exchanger 23 is connected at the upstream side via a discharge line 27' with cold water outlet 28 on the regenerator 21. Still further, the cold heat exchanger 23 is connected at the downstream side via a supply line 23' to cold water inlet 29 on the regenerator 21. Said line 22' and said line 23' are interconnected with a line 27 in which is located a pumping means 24. In the present embodiment, the latter is selected as a piston pump. With the present embodiment, the arrangement of said connections 25, 26; 28, 29 of hot water and, respectively, of cold water on the elastocaloric regenerator 21 is formed in a direct manner, which means that the hot water outlet 25 and the hot water inlet 26 are located at the first end of the regenerator 21, whereas the cold water outlet 28 and the cold water inlet 29 are located at the opposite eend of the regenerator 21. Obviously, said arrangement of the hot water and, respectively, of cold water connections 25, 26; 28, 29 on the regenerator 21 can be formed also in the crosswise manner.

Said deformable condenser and, respectively, the hot heat exchanger 21' operates in a manner of a piston, a bellow or similar, and due to its deformation by means of said exchanger 17 enables deformation of the elastocaloric material of the regenerator 21. Physical background and individual operational stages are same as with the above described first embodiment. Loading of such regenerator 21 is carried out by means of a vapour-compression cooler. For example, said regenerator 21 comprises a porous structure of elastocaloric material through which medium flows in a counterflow manner during respective stages of the operation. If appropriate operational conditions are met, then during cyclic operation, a temperature profile is established between the hot heat exchanger 22 and the cold heat exchanger 23 along the regenerator 21, that is in the direction of medium flow.

A cyclic process of cooling/heating of the present second embodiment of the hybrid thermal apparatus comprises four stages as follows. The first stage comprises pressing by means of the compressing means 19 the cooling agent into the hot heat exchanger 21'. The expansion valve 20 is closed, and water circulating through the heat exchangers 22, 23 is prevented during the entire first stage of the process or at least during a part of the first stage of the process. The compression means 19 presses cooling agent into the heat exchanger 21' which is consequently deformed. Said deformation of the hot heat exchanger 21' is transferred by means of said load transmitter 17 to the regenerator 21. Increasing the pressure of the cooling agent in the heat exchanger 21' reflects in increasing the deformation of the regenerator 21 which consequently warms up. The final outcome of the first stage reflects in deformed regenerator 21 and compresses cooling agent in the hot heat exchanger 21', wherein both the heat exchanger 21' and the regenerator 21 are now in the warmed-up state.

The second phase of the cyclic cooling/heating process of the present second embodiment of the hybrid thermal apparatus comprises heat removal from the hot heat exchanger 21' and regenerator 21. The flow of the compressed cooling agent into the vapour-compression apparatus 15 is prevented during the entire second stage of the process or at least during a part of the second stage of the process, wherein the heat exchanger 21' dissipates heat to the surrounding or to any other media for heat transfer. The pumping means 24 presses water having a third temperature $T_3$ through the regenerator 21, and through the hot water outlet 25 from the regenerator 21 having a first temperature $T_1$. The heat is transferred from the hot regenerator 21 to the cold water, which consequently warms up, and hot water with the first temperature $T_1$ continues its way through the hot water outlet 25. The pumping means 24 presses hot water with the first temperature $T_1$ through the hot heat exchanger 22 where the water is cooled down, wherein the hot heat exchanger 22 dissipates the heat either to the surrounding or to any other media for heat transfer. The final outcome of the second stage is represented by a deformed regenerator 21 and by compressed cooling agent in the heat exchanger 21'. Hot water is placed at the disposal in the hot heat exchanger 22, where it is cooling down, wherein a first hot product is obtained. Said cooling down of the heat exchanger 21' results in a second hot product.

The third stage of the cyclic cooling/heating process of the present second embodiment of the hybrid thermal apparatus comprises expansion of the cooling agent from the hot heat exchanger 21' into the cold heat exchanger 18. Inflow of the compressed cooling agent into the heat exchanger 21' is prevented, wherein the water flow through the regenerator 21 is prevented during the entire third stage of the process or at least during a part of the third stage of the process. The cooling agent expands via the expansion valve from the heat exchanger 21', therefore, the cooling agent cools down resulting in a first cold product in the cold heat exchanger 18. Due to said expansion the heat exchanger 21' is getting empty, resulting in decreasing of deformation of the regenerator 21, which consequently cools down. The final outcome of the third stage represents expanded cooling agent, heat exchanger 18 being cooled down, and non-deformed and cold regenerator 21.

The fourth stage of the cyclic cooling/heating process of the present second embodiment of the hybrid thermal apparatus comprises cooling down the water in the cooled elastocaloric material of the regenerator 21, wherein the first thermal apparatus 15 is idle during the entire fourth stage of the process or at least during a part of the fourth stage of the process. Water having a second temperature $T_2$ flows from the hot heat exchanger 22 through the inlet 26 into the regenerator 21, and through the outlet 28 into the cold heat exchanger 23. Here, said water gets slightly cooled down to the temperature $T_4$, and the regenerator 21 gets slightly warmed up. The water, cooled down in said manner, having the temperature $T_4$ flows into a cold heat exchange 23, wherein a second cold product is obtained. The final outcome of the fourth stage is represented by cold water in the cold heat exchanger 23 and non-deformed regenerator 21.

With the present second embodiment, said second temperature $T_2$ of the water is higher than said first temperature $T_1$ of the water ($T_2>T_1$), and said fourth temperature $T_4$ of the water is higher than said third temperature $T_3$ of the water ($T_3<T_4$). In addition, it applies that the first and the second temperature $T_1$, $T_2$ are substantially higher that the third and the fourth temperature $T_3$, $T_4$ ($T_1<T_2<<T_3<T_4$).

On conclusion of said fourth stage said cyclic process of the hybrid thermal apparatus according to the invention returns to the first stage, thus, enabling the cyclic process to be carried out continuously.

Various arrangements of individual elements of the hybrid thermal apparatus according to the invention, such as a cooling apparatus or a heat pump for instance, render possible different embodiments by means of which is enabled continuous operation of the thermal apparatus, and increasing of power and efficiency thereof. An embodiment is possible, for example, comprising a parallel piping of at least two deformable heat exchangers 3 made of elastocaloric material, enabling, by means of a reciprocal operation of individual stages, a continuous operation of the compression means 5 and the pumping means 9; 12.

It is of course obvious, that other modified embodiments of the hybrid thermal apparatus according to the invention are possible, without departing from the spirit of the invention. For example, with the first embodiment of the hybrid thermal apparatus according to the invention, said thermal apparatus 3 can be arranged in a by-pass. Further, with the second embodiment, the deformation and, respectively, the load transmitter 17 can be eliminated from the system. It is achieve din this manner, that the thermal apparatus 2 operates only when needed and, respectively, in case of a demand for higher cooling or heating power. Furthermore, it is understood that respective locations are provided with various closure means and/or control means, such as one-way or multi-way valves and similar, which, however, are not the subject of the present invention, and, therefore, are not described in detail.

The invention claimed is:

1. A hybrid thermal apparatus comprising at least one heat exchanger and at least one heat source and/or heat sink, wherein said hybrid thermal apparatus is formed as a combination of a first thermal apparatus based on a vapour-compression principle and comprising a first medium for heat transfer, and of a second thermal apparatus based on an elastocaloric principle and comprising a second medium for heat transfer, wherein said first and second thermal apparatuses have at least one third thermal apparatus in common comprising at least a deformable heat exchanger made of elastocaloric material.

2. The hybrid thermal apparatus according to claim 1, wherein said third thermal apparatus is selected as a elastocaloric heat exchanger, which is deformable by pressing cooling agent of the first thermal apparatus into the deformable heat exchanger to deform the elastocaloric material of said heat exchanger.

3. The hybrid thermal apparatus according to claim 1, wherein said third thermal apparatus is selected as an elastocaloric regenerator which is deformable by pressing cooling agent of the first thermal apparatus into a hot heat exchanger, which is deformed, wherein a deformation of the hot heat exchanger is transferred to the regenerator to deform the elastocaloric material of said regenerator.

4. The hybrid thermal apparatus according to claim 3, wherein the hot heat exchanger is selected as a deformable condenser.

5. The hybrid thermal apparatus according to claim 1, wherein the first thermal apparatus comprises a first cold heat exchanger connected at first side to a compressor and connected at the other side to an expansion valve, wherein both the compressor and the expansion valve are connected with the deformable heat exchanger.

6. The hybrid thermal apparatus according to claim 5, wherein the first cold heat exchanger is selected as an evaporator.

7. The hybrid thermal apparatus according to claim 1, wherein each heat exchanger is connected with the deformable heat exchanger.

* * * * *